US009111710B2

(12) United States Patent
Wouters et al.

(10) Patent No.: US 9,111,710 B2
(45) Date of Patent: Aug. 18, 2015

(54) SOCKETED HIGH PRESSURE GAS DISCHARGE LAMP

(75) Inventors: Geert Wouters, Turnhout (BE); Luc Stefaan Emmanuel Lammerant, Turnhout (BE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 13/124,970

(22) PCT Filed: Oct. 13, 2009

(86) PCT No.: PCT/IB2009/054487

§ 371 (c)(1), (2), (4) Date: Apr. 19, 2011

(87) PCT Pub. No.: WO2010/046805

PCT Pub. Date: Apr. 29, 2010

(65) Prior Publication Data

US 2011/0198992 A1 Aug. 18, 2011

(30) Foreign Application Priority Data

Oct. 21, 2008 (EP) ..... 08167124

(51) Int. Cl.

| | |
|---|---|
| ***H01J 61/067*** | (2006.01) |
| ***H01J 5/54*** | (2006.01) |
| ***H01J 5/56*** | (2006.01) |
| ***H01J 5/58*** | (2006.01) |
| ***H01J 9/34*** | (2006.01) |
| ***H01J 61/52*** | (2006.01) |

(52) U.S. Cl.

CPC ... *H01J 5/56* (2013.01); *H01J 5/58* (2013.01); *H01J 9/34* (2013.01); *H01J 61/52* (2013.01)

(58) Field of Classification Search

CPC ..... H01J 9/34; H01J 5/58; H01J 7/24
USPC ..... 313/318.03, 318.08, 318.01, 44, 53, 313/318.07

See application file for complete search history.

(56) References Cited

U.S. PATENT DOCUMENTS

| | | | | |
|---|---|---|---|---|
| 3,859,554 | A * | 1/1975 | Preziosi et al. | 313/315 |
| 4,694,215 | A * | 9/1987 | Hofmann | 313/44 |
| 4,937,487 | A * | 6/1990 | Blaisdell et al. | 313/318.09 |
| 6,163,102 | A * | 12/2000 | Tucker et al. | 313/113 |
| 6,578,991 | B2 | 6/2003 | Beaumont | |
| 2004/0095069 | A1 | 5/2004 | Yamashita | |
| 2006/0056183 | A1 | 3/2006 | Yamamizu et al. | |
| 2007/0018550 | A1 | 1/2007 | Kolodziejczyk | |

FOREIGN PATENT DOCUMENTS

| | | | |
|---|---|---|---|
| CN | 201017852 | Y | 2/2008 |
| JP | H02-47765 | U | 4/1990 |
| JP | 06267512 | A | 9/1994 |
| JP | 2002140978 | A | 5/2002 |
| JP | 2007305600 | A | 11/2007 |
| WO | 2007031913 | A1 | 3/2007 |
| WO | 2008092503 | A1 | 8/2008 |

* cited by examiner

*Primary Examiner* — Karabi Guharay

(57) ABSTRACT

A socketed high pressure gas discharge lamp having a lamp vessel comprising a space sealed by at least one seal. The discharge lamp further comprising a socket in which the lamp vessel is mounted with its seal and fixed with cement. A lamp axis extending through the socket and through the space of the lamp vessel. The socket is provided with at least one opening extending axially through the socket from its base side to its front side. The opening has an annular wall which is either formed only by the socket or by a combination of both the socket and the seal of the lamp vessel. Preferably, the opening is located on either side of the seal.

8 Claims, 3 Drawing Sheets

SOCKETED HIGH PRESSURE GAS DISCHARGE LAMP

FIELD OF THE INVENTION

The invention relates to a socketed high pressure gas discharge lamp.

The socketed high pressure gas discharge lamp comprises:

a lamp vessel comprising an electric element arranged in a gastight discharge space, said space being sealed by a seal;

a socket in which the lamp vessel is mounted with said seal, the socket having a base side facing away from the space and a front side facing towards the space;

a lamp axis extending through the socket and through the space;

at least one current conductor extending in the axial direction through said seal from the electric element to the exterior.

BACKGROUND OF THE INVENTION

Such a socketed lamp is known from U.S. Pat. No. 6,578,991B2. In the known lamp a construction for cooling a lamp vessel is disclosed. In general, cooling is required for lamps that are operated at relatively very high temperatures, for example special metal halide lamps, such as MSR lamps that are used for stage, studio, and theatre lighting. In particular, cooling is applied to lamp parts that are sensitive to oxidation, such as electrical current conductors at the location where they issue from the seals of the lamp vessel to the exterior. Therefore, in the known lamp a special construction is disclosed that aims at cooling only the seals. The construction comprises a large air chamber and a spout. It is a drawback of the known lamp that the construction to cool the seal is relatively bulky and expensive. Another drawback of the known lamp is that the cooling construction comprises many parts that have to be mounted and positioned onto the lamp vessel.

SUMMARY OF THE INVENTION

It is an object of the invention to counteract at least one of the drawbacks of the lamp of the type as described in the opening paragraph. To achieve this, said lamp is characterized in that the socket is provided with at least one opening which extends in the axial direction through the socket from the base side to the front side and in that the lamp vessel is fixed with its seal with cement in the socket. When the lamp is operated in upright position, i.e. the axis extends in the vertical direction and the base is above the lamp vessel, the elongated shape of the opening and the relatively high temperature of the lamp vessel at its discharge space, causes a natural convection flow of gas, for example air, alongside the seal. Thus, it is counteracted that the seal and metal parts issuing from said seal become too hot and hence the speed of degradation of the seal and/or current feedthrough is reduced. In other lamp burning positions, for example horizontal or upside-down, natural convection will not work properly and cooling via a forced flow can be properly used, for example by using a fan. The desired orientation of the flow is imposed by the orientation of the opening with respect to the lamp vessel, i.e. the axial orientation of the opening causes the flow to pass alongside the seal. It might be sufficient to cool only the hottest part of the seal, i.e. the side of the seal that is in the upper position, in case the lamp is operated in the horizontal position, which can be achieved with the socket having only one opening. Additionally, cooling of the discharge is enabled likewise. Fixation of the lamp vessel with cement is a convenient and relatively cheap way of fixation and avoids use of relatively expensive and relatively complex mechanical mounting constructions.

Alternatively, the socket may have two or more openings to enable two-sided or more circumferential cooling of the seal. To attain uniform cooling of the seal, the openings preferably are evenly distributed over the circumference of the socket. The lamp vessel usually is made of glass, for example hard glass but preferably quartz glass, i.e. glass with a $SiO_2$ content of at least 95% by weight.

In an embodiment, the socketed lamp is characterized in that the opening has an annular wall which is formed by the socket. This has the advantage of a very robust fixation of the lamp vessel in the socket as the seal is cemented on all sides via the whole external surface of the seal that is located inside the socket. Alternatively, an embodiment of the socketed lamp is characterized in that the opening has an annular wall which is formed by a combination of both the socket and the seal of the lamp vessel. By virtue thereof, the socketed lamp has the advantage of an enhanced cooling efficiency of the seal as parts of the seal that are located inside the socket are directly exposed to the flow of cooling medium.

The seal can be a collapsed seal or a pinch seal. A collapsed seal is made in a sealing process in which the glass is softened to a relatively low viscosity for enabling the glass to contract itself due to its surface energy and thus to embed the current conductor inside the glass and to seal the discharge space. A pinch seal is made via a pinching process during which the pinch blocks shape the softened glass of a seal portion of the lamp vessel into a pinch seal. The closest distance between the pinch blocks during the pinching process determines the thickness of the pinch seal, while the pinch block surface that contacts the softened glass determines the width of the pinch seal. In the case of the pinch seal, a preferred embodiment of the socketed lamp is characterized in that the openings are located on either side of the seal facing a respective width surface. This has the advantage of enhanced cooling efficiency as a relatively large area of the pinch seal is directly exposed to the cooling medium.

The lamp vessel may be a double-ended lamp vessel, i.e. a lamp vessel having two, mutually oppositely positioned seals each with a respective current conductor, or it may be a single ended lamp vessel, i.e. a lamp vessel with only one seal through which seal all the current conductors extend.

BRIEF DESCRIPTION OF THE DRAWINGS

These and other aspects of the invention will be further elucidated and described in the drawing, in which.

DETAILED DESCRIPTION OF EMBODIMENTS

Figure 1:
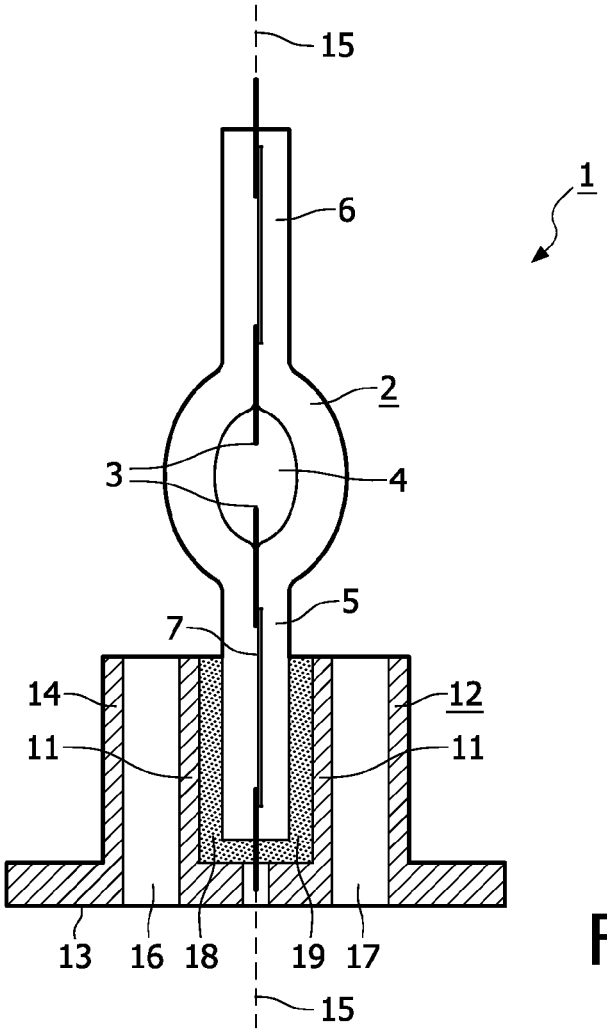
FIG. 1 shows a cross sectional view of a first embodiment of the socketed high pressure gas discharge lamp according to the invention.

In FIG. 1 a socketed high pressure gas discharge lamp 1 is shown. The socketed lamp comprises a lamp vessel 2 comprising an electric element 3 arranged in a gastight discharge space 4, said space being sealed by a first 5 and a second seal 6. The socketed lamp further comprises a socket 12 of a high temperature resistant ceramic material, in this case aluminum oxide, in which the lamp vessel 2 is firmly fixed with an adhesive compound 19, in this case cement, with said first seal 5 being in a recess 18 of the socket. The socket has a base side 13 facing away from the space 4 and a front side 14 facing towards the space. A lamp axis 15 extends through the socket 12, through the first seal 5 and into the space 4. A current conductor 7 extends axially through said first seal 5 from the electric element to the exterior. The socket is provided with two openings 16,17 which extend axially through the socket from the base side to the front side. The openings 16,17 are separated from the recess 18 by a respective annular wall 11. The discharge lamp shown is a MSR Gold 1200 Watt AC lamp of Philips, with a filling of mercury, a mixture of salts of rare earth metals, and argon as a starting gas.

Figure 2:
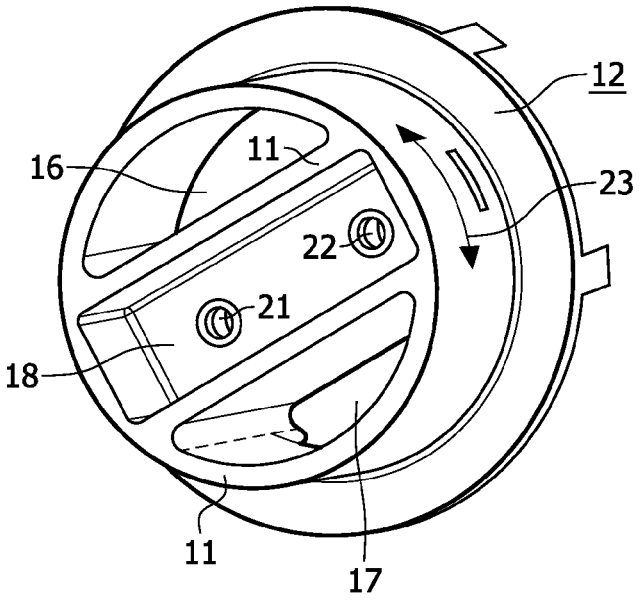
FIG. 2 shows an elevated top view of the socket of the socketed lamp of FIG. 1.

In FIG. 2 the socket 12 of the socketed lamp of FIG. 1 is shown. The socket has two axially extending openings 16, 17 that are evenly annularly distributed over the circumference 23 of the socket. Each opening has an annular wall 11 which is completely formed by the material of the socket and hence the openings are separated from the recess 18 in which the lamp vessel is to be mounted with its first seal (see FIG. 1). Two passages 21,22 in the recess 18 are meant for electric conductors (see reference numeral 7 in FIG. 1) issuing from the lamp vessel to pass to the base side of the socket. The socket is made of a glass-ceramic material having a coefficient of thermal expansion that is about the same as the coefficient of thermal expansion of quartz glass, i.e. in the range of $1*10^{-7}$ to $1*10^{-6}$ $K^{-1}$.

Figure 3:
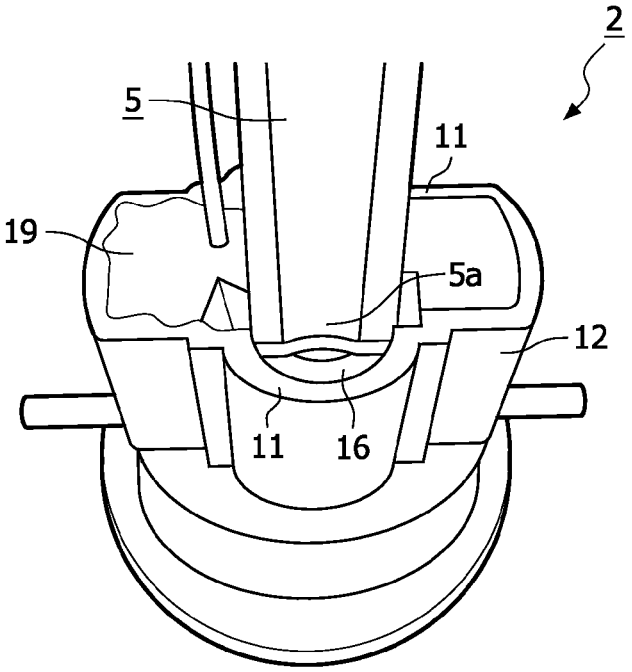
FIG. 3 shows an elevated view of a second embodiment of the socketed high pressure gas discharge lamp according to the invention.
Figure 4:
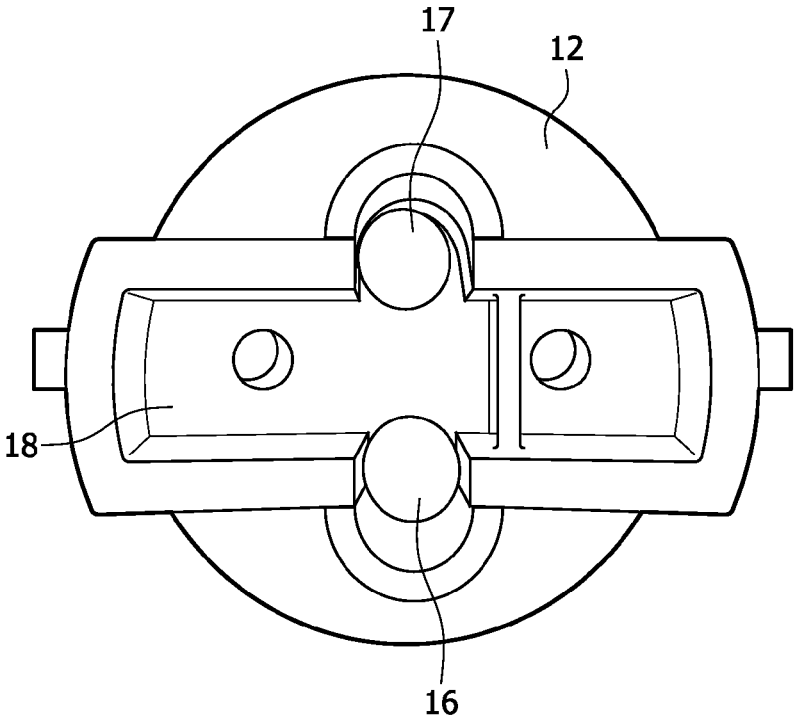
FIG. 4 shows a top view of the socket of the socketed lamp of FIG. 3.

The socketed lamp 1 of FIG. 3 shows a lamp vessel 2 fixed with cement 19 in the socket 12, with parts of the first pinch seal 5 that are located inside the socket being free from cement and forming part of annular walls 11 that surround the axially extending openings 16, of which only one opening is visible, in the socket. The openings are located on either side of the seal and face a respective width surface 5*a* of the seal. As shown in FIG. 4, which is a top view of only the socket 12 of the socketed lamp of FIG. 3, both the openings 16, 17 and the recess 18 are integral, and are subdivided by the first seal 5 of the lamp vessel to form the openings 16, 17 in the socket. In this embodiment, the fixation of the lamp vessel in the socket is somewhat less robust, but enables efficient cooling of the seal 5 and current conductors 7 (see FIG. 1) of the lamp, as parts of these components that are located in the socket are exposed directly to cooling gas flowing through the openings.

Figure 5:
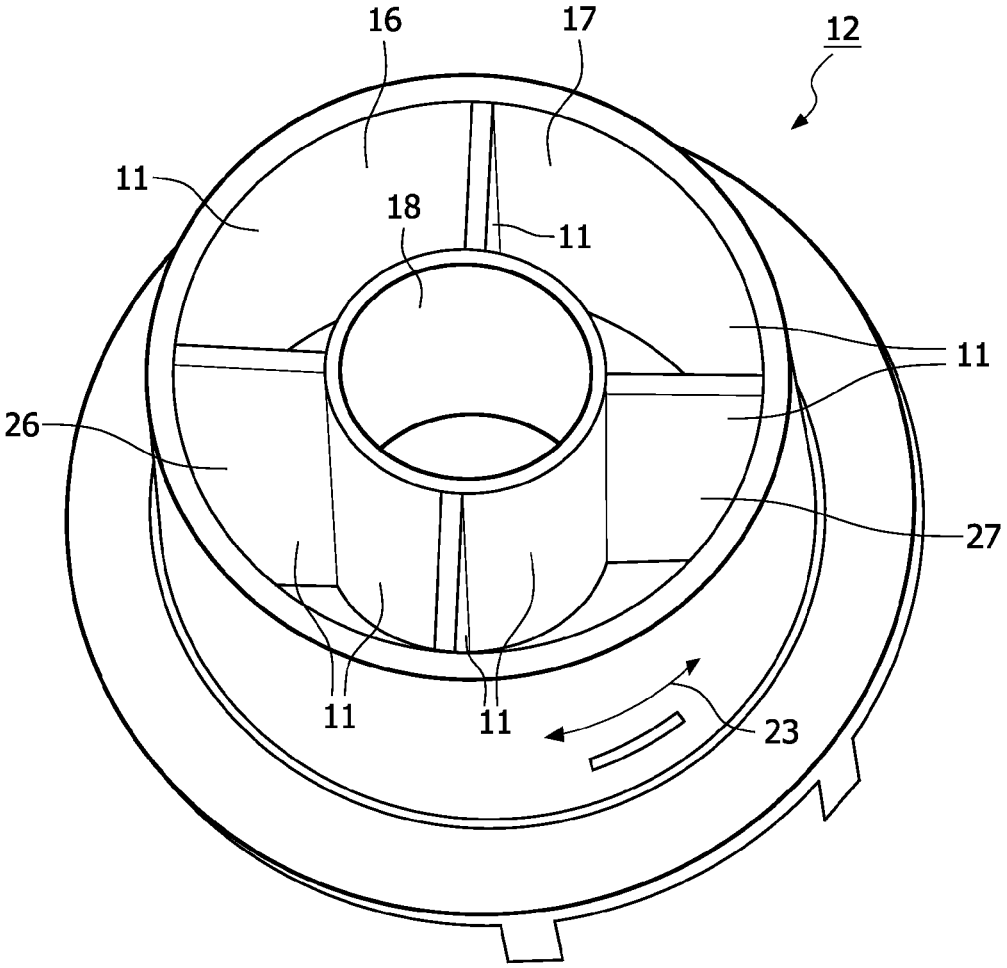
FIG. 5 shows an elevated top view of a third embodiment of a socket of a gas discharge lamp according to the invention.

In FIG. 5 a third embodiment of a socket 12 according to the invention 1 is shown. The socket has four axially extending openings 16,17,26,27 that are evenly annularly distributed over the circumference 23 of the socket. Each opening has an annular wall 11 which is completely formed by the material of the socket and hence the openings are separated from the recess 18 in which the lamp vessel is to be mounted with its first seal. In FIG. 5 the recess 18 is suited for accommodating a lamp vessel which has a collapsed first seal. In the Figure the socket is made of sintered aluminum oxide.

The invention claimed is:

1. A socketed high pressure gas discharge lamp comprising:

a lamp vessel comprising an electric element arranged in a gastight discharge space, said discharge space containing at least one gas and being smaller than and totally contained within the lamp vessel, and being sealed by a seal;

a socket in which the lamp vessel is mounted with said seal, the socket having a base side facing away from the discharge space and a front side facing towards the discharge space;

a lamp axis extending through the socket and through the discharge space;

at least one current conductor extending in the axial direction through said seal from the electric element to the exterior;

wherein the socket is provided with at least one opening which extends in the axial direction completely through the socket from the base side to the front side, said opening providing a passageway through which a cooling medium can flow, thereby providing cooling to the seal when the lamp is in operation;

wherein the lamp vessel is fixed with cement with its seal in the socket; and, wherein the discharge space comprises two current conductors, each essentially collinear with the lamp axis, and being spaced apart in the axial direction.

2. A socketed lamp as claimed in claim 1, characterized in that the socket comprises at least two of said openings.

3. A socketed lamp as claimed in claim 1, characterized in that the opening has an annular wall which is formed by the socket.

4. A socketed lamp as claimed in claim 1, characterized in that the opening has an annular wall which is formed by a combination of both the socket and the seal of the lamp vessel.

5. A socketed lamp as claimed in claim 4, characterized in that the seal is a pinch seal, said pinch seal having a width surface and a thickness, and in that the openings are located on either side of the seal, facing a respective width surface.

6. A socketed lamp as claimed in claim 1 wherein the pressure of said at least one gas in the discharge space is greater than atmospheric pressure.

7. A socketed high pressure gas discharge lamp comprising:

a lamp vessel comprising an electric element arranged in a gastight discharge space, said discharge space containing at least one gas and being smaller than and totally contained within the lamp vessel, and being sealed by a seal;

a socket in which the lamp vessel is mounted with said seal, the socket having a base side facing away from the discharge space and a front side facing towards the discharge space;

a lamp axis extending through the socket and through the discharge space;

at least one current conductor extending in the axial direction through said seal from the electric element to the exterior;

wherein the socket is provided with at least one opening which extends in the axial direction completely through the socket from the base side to the front side, said opening providing a passageway through which a cooling medium can flow when the lamp is inserted into a fixture;

wherein the lamp vessel is fixed with cement with its seal in the socket; and, wherein the discharge space comprises two current conductors, each essentially collinear with the lamp axis, and being spaced apart in the axial direction.

8. A socketed lamp as claimed in claim 7 wherein the pressure of said at least one gas in the discharge space is greater than atmospheric pressure.

* * * * *